US005517910A

United States Patent [19]

Skahan

[11] Patent Number: 5,517,910

[45] Date of Patent: May 21, 1996

[54] SELF-LEVELING DIE PLATEN FOR DIE STAMPING PRESSES

[75] Inventor: John T. Skahan, Olathe, Kans.

[73] Assignee: Preco Industries, Inc., Lenexa, Kans.

[21] Appl. No.: 367,958

[22] Filed: Jan. 3, 1995

[51] Int. Cl.[6] ..... B31F 1/07

[52] U.S. Cl. ..... 101/27; 101/31; 425/149

[58] Field of Search ..... 101/93, 9, 27, 101/21, 25, 31, 32, 474, 487, DIG. 31; 425/149, 143; 100/53

[56] References Cited

U.S. PATENT DOCUMENTS

| | | | |
|---|---|---|---|
| 3,584,487 | 6/1971 | Carlson | 101/27 |
| 4,240,778 | 12/1980 | Korytko | 425/149 |
| 4,343,670 | 8/1982 | Brown | 101/DIG. 1 |
| 4,409,063 | 10/1983 | Brown | 101/DIG. 1 |
| 4,481,847 | 11/1984 | Schneider et al. | 83/530 |
| 4,624,126 | 11/1986 | Avila | 101/28 |
| 4,706,565 | 11/1987 | Martin et al. | 101/151 |
| 5,201,204 | 4/1993 | Hinterman et al. | 72/19 |
| 5,299,444 | 5/1994 | Kirii et al. | 101/28 |

*Primary Examiner*—Eugene H. Eickholt
*Attorney, Agent, or Firm*—Hovey, Williams, Timmons & Collins

[57] ABSTRACT

A self-leveling die platen assembly (32) is provided which includes a shiftable platen (78) which can rock as necessary to accommodate the configuration of a cooperating platen assembly (30). Preferably, the assembly (32) includes a stationary die shoe (46) provided with a fluid reservoir (50); a piston (68) is rockably received within reservoir (50) and supports the platen (78). During stamping or cutting operations, the platen (78) can thus move and self-adjust as necessary to accommodate the configuration of cooperating platen assembly (30). The self-adjusting assembly (32) greatly facilitates makeready operations.

16 Claims, 5 Drawing Sheets

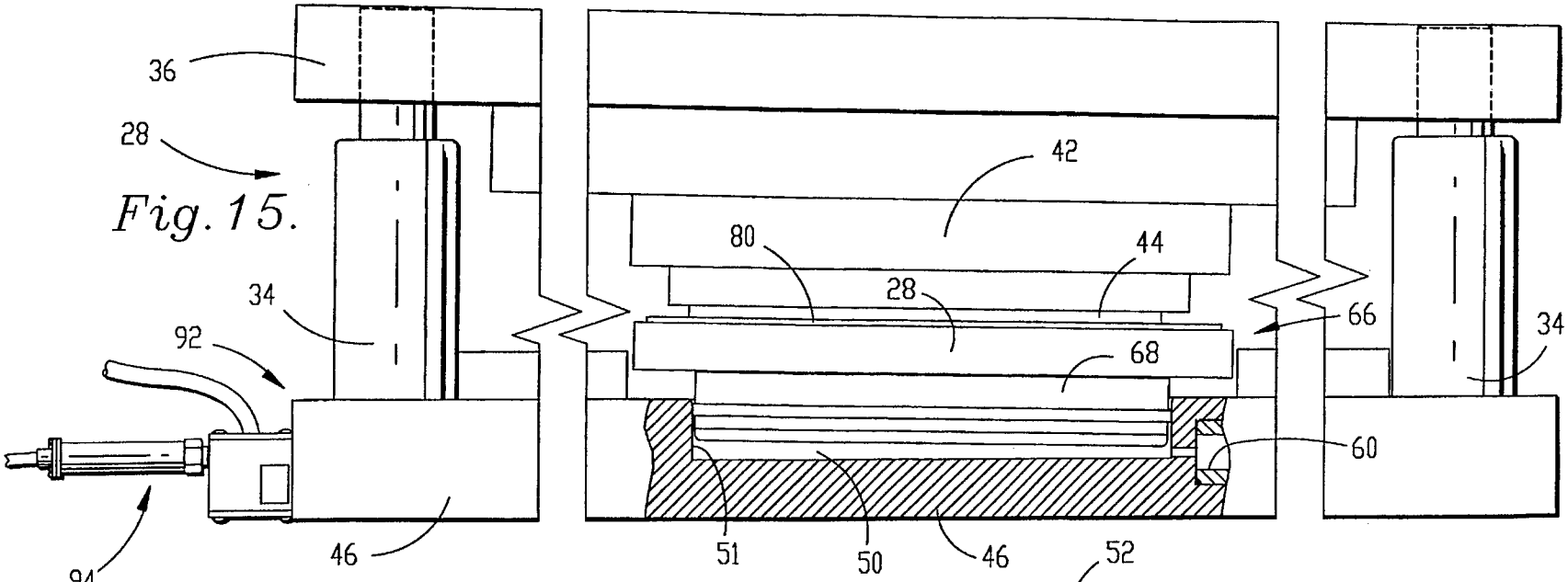
Fig. 15.
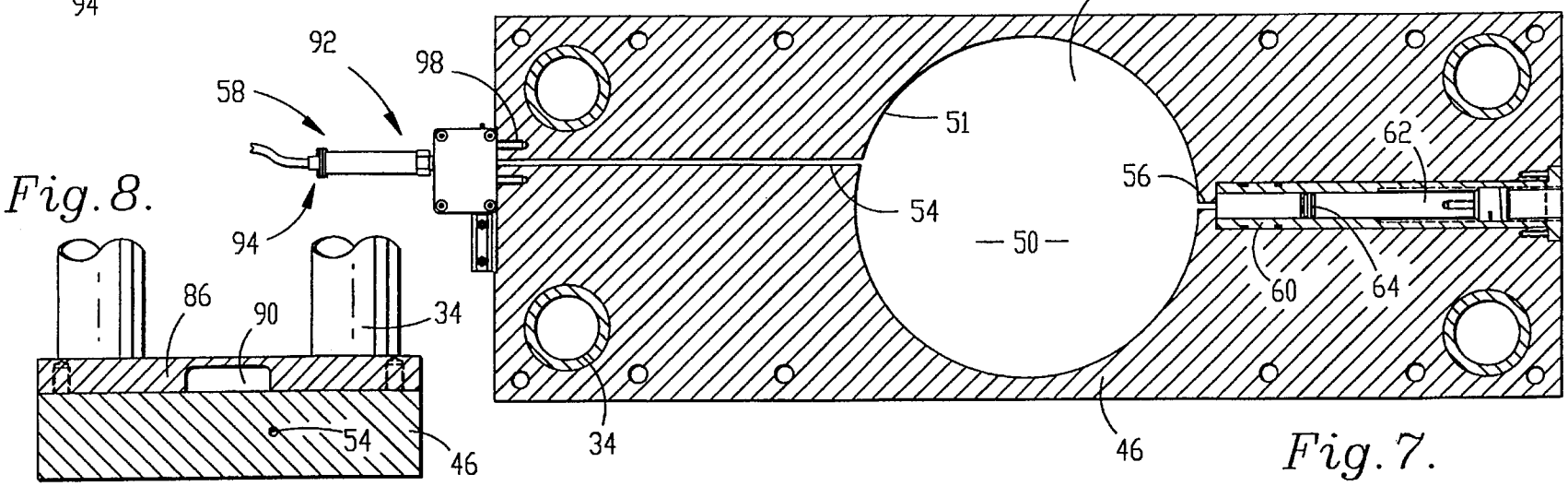
Fig. 7.
Fig. 8.

SELF-LEVELING DIE PLATEN FOR DIE STAMPING PRESSES

BACKGROUND OF THE INVENTION

1. Field of the Invention

The present invention is broadly concerned with an improved die platen assembly adapted for use on die stamping presses in order to facilitate the makeready of such devices. Automatic self-adjustment of one of the platen assemblies is provided during use to accommodate the configuration of the opposing platen assembly. More particularly, the invention pertains to such a self-adjusting die platen assembly which includes a shoe presenting a fluid reservoir with a platen-supporting piston shiftably positioned within the reservoir; the piston and die platen are rockably shiftable for adjusting the orientation of the platen operating face to accommodate the configuration of the cooperating die plate assembly during use of the die set.

2. Description of the Prior Art

Die stamping machines have wide application for performing various operations on a number of different substrates including paper, plastic and metal film. The stamping machines have mutually cooperable die sets, or a die set in association with an anvil platen. In all instances though, it is necessary that the interengageable surfaces of the die sets or die and anvil platen be in parallel relationship. Die makeready therefore necessarily involves a series of preparatory set-up operations directed toward obtaining parallelism to the extent possible between mutual engageable surfaces of the die sets or anvil.

For example, where stamping presses are used in the paper converting industry to create blanks, or form perforations for crease lines in a workpiece it is desirable that the blanking, perforating or creasing surface of the die be parallel to the underlying die or platen face. Otherwise, significant makeready must be carried out to compensate for lack of parallelism between the mutually cooperating surfaces. Generally speaking, the differences between parallel and non-parallel are very small increments of a few thousandths of an inch. However, these seemingly small differences cause very large variations in the output product.

In the case of stamping dies having a steel rule die operable against an opposed flat platen face, it is not uncommon for portions of the operating edge of the steel rule to be of greater height than other segments of the rule. As a result, when the steel rule die is moved toward a workpiece positioned on the supporting anvil platen, those portions of the steel rule die which are highest engage the workpiece before other portions of the working edge of the rule contact the substrate. As a result, the cut, crease or perf line is not uniform throughout the extent of the steel rule.

Accordingly, the metallic rules used with such devices must either be very precisely and carefully fabricated to assure that all cuts, crease lines or perforations are properly placed on the workpiece, and are also correct as to depth of cut. Otherwise, substantial compensatory makeready must be accomplished using workpiece backup components.

In general, die makeready involves preliminary placement of the rule, followed by numerous trial runs and adjustments of the rule until proper rule placement is achieved. This process is not only time-consuming, but requires considerable operator skill.

In like manner, male and female die sets frequently require makeready adjustment as a result of disparities in the height of the operating edge or surface of one die along the length of the edge or surface which interacts with the complemental operating portion of the opposed die.

There is therefore a decided need in the art for an improved die set which provides a self-adjusting feature which provides compensation for height differences in the working surfaces of a die to facilitate and shorten the time involved in makeready operations.

SUMMARY OF THE INVENTION

The present invention overcomes the problems outlined above, and provides a greatly improved self-adjusting die platen assembly for use with a cooperating die platen assembly to form a die set. Broadly speaking, the self-adjusting die platen assembly of the invention includes a stationary shoe presenting a fluid reservoir, advantageously in the form of a cylindrical opening, together with a piston shiftably positioned within the reservoir in contact with the fluid therein. A die platen having an operating face is carried by the piston and shifts therewith. The piston is movable within the reservoir for adjusting the orientation of the platen operating face to accommodate the configuration of the cooperating die platen assembly during use of the die set.

In preferred forms, the piston and platen are rockable within the reservoir about two perpendicular axes both parallel with the platen operating face to accommodate the configuration of the mating platen assembly. In this way, when the platen assemblies are moved together for operation on a workpiece, the shiftable platen may rock or shift as necessary to accommodate the configuration of the opposing platen assembly. In practice, the self-adjusting assembly of the invention is used as the workpiece-supporting platen assembly, which coacts with a rule-supporting platen assembly.

In further preferred aspects of the invention, means is provided for selectively adjusting the rest location of the piston and platen, i.e., their location when the platen assemblies of the die set are shifted apart. Moreover, structure is preferably provided for detecting the fluid pressure within the reservoir during use of the die set.

BRIEF DESCRIPTION OF THE DRAWINGS

FIG. 7 is a sectional view taken along line 7—7 of FIG. 5 which depicts the details of construction of the die shoe;

FIG. 8 is a vertical sectional view taken along line 8—8 of FIG. 5;

FIG. 15 is a schematic view similar to that of FIG. 1 and illustrating the self-adjusting operation of the platen assembly of the invention.

DETAILED DESCRIPTION OF THE PREFERRED EMBODIMENT

Figure 2:
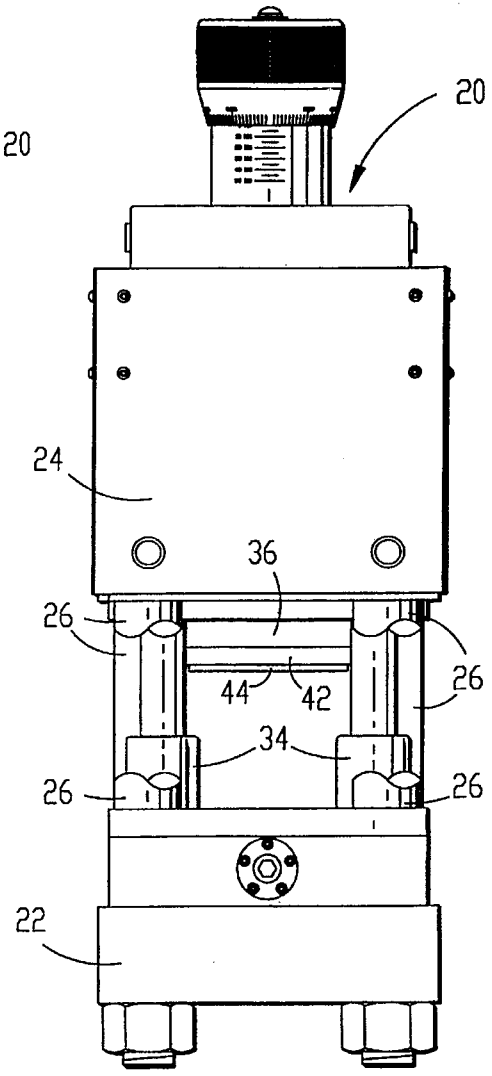
FIG. 2 is an end view of the stamping press depicted in FIG. 1.
Figure 1:
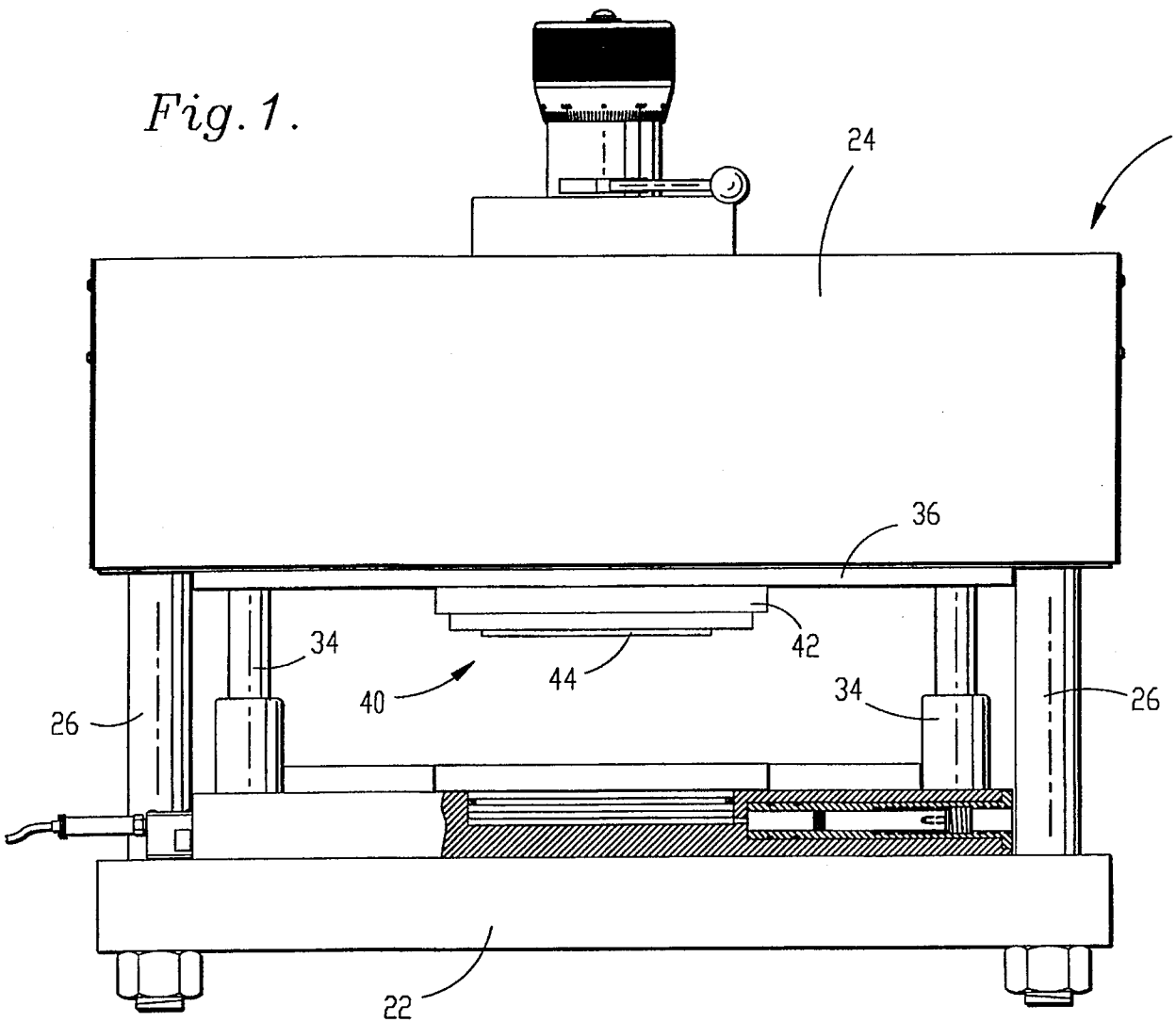
FIG. 1 is a side view partially in section and illustrating a stamping press incorporating the preferred die set construction of the present invention.

Turning now to the drawings, and particularly FIGS. 1–2, a stamping press 20 is illustrated. The press 20 includes a lower bolster 22 as well as an upper, opposed press head 24. The bolster 22 and head 24 are interconnected by means of columns 26 and are themselves conventional.

Figure 5:
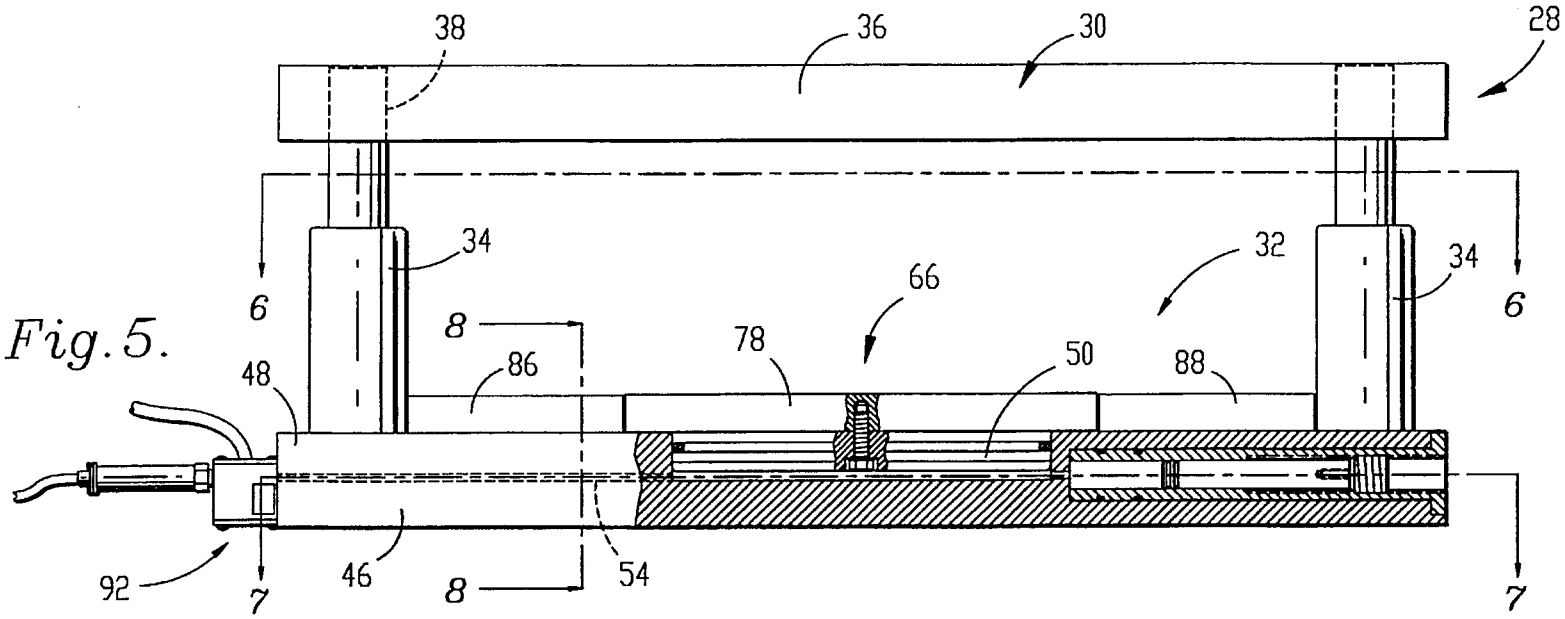
FIG. 5 is a fragmentary side view partially in section, and illustrating the die set of the press of FIGS. 1–2.

As best seen in FIG. 5, the overall press 20 includes an operating die set 28. The die set 28 for purposes of illustrating the advantages of this invention is shown as having an upper platen assembly 30 adapted to support a stamping rule, as well as a lower self-adjusting platen assembly 32. It is to be understood though that the principles of this invention are applicable to die assemblies containing dies other than steel rule dies.

The assemblies 30, 32 are interconnected and supported for shifting movement of the upper platen assembly by means of upright, shouldered bushings 34. Upper platen assembly 30 is essentially conventional and is in the form of an elongated, substantially rectangular upper plate 36 having marginal openings 38 therein for receiving the upper ends of the bushings 34.

In the stamping press as shown in FIG. 1, it will be observed that exemplary cutting die 40 is fixedly mounted to the lower face of plate 36. The die 40 includes a mount 42 which is bolted to plate 36, with metallic steel rule 44 in this instance carried by mount 42 with the operating surface of the rule 44 projecting outwardly from the lower face of such mount.

Figure 6:
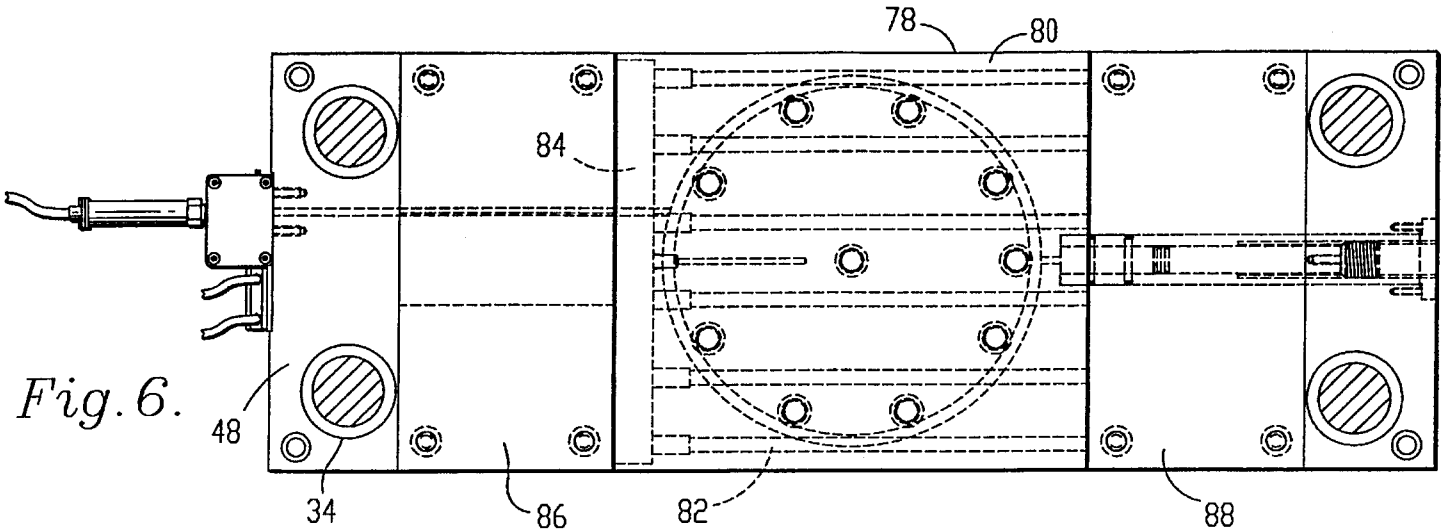
FIG. 6 is a sectional view taken along line 6—6 of FIG. 5 and illustrating the construction of the self-adjusting plate assembly.

Lower platen assembly 32 provides the self-adjusting feature of the invention. Referring to FIGS. 5–6, it will be observed that the lower assembly 32 includes a substantially rectangular metallic die shoe 46 presenting an upper surface 48. The bushings 34 are supported by shoe 46 as seen in FIGS. 5 and 7. The shoe 46 includes at the central region thereof a reservoir 50 which is circular in plan configuration and extends downwardly from surface 48, presenting upright sidewall 51 and planar lower surface 52. The shoe 46 is also provided with a pair of fluid passageways 54, 56 each in communication with reservoir 50 (see FIG. 7). The passageway 54 communicates with a pressure sensor 58, whereas passageway 56 communicates with the interior of a tubular insert 60 carried by shoe 46. A piston member 62 is situated within insert 60 and is threadably shiftable therein. The piston 62 is equipped with inner seals 64 so as to prevent flow of motive fluid within reservoir 50 past the piston member.

Figures 9, 10, 11, 12, 13, 14:
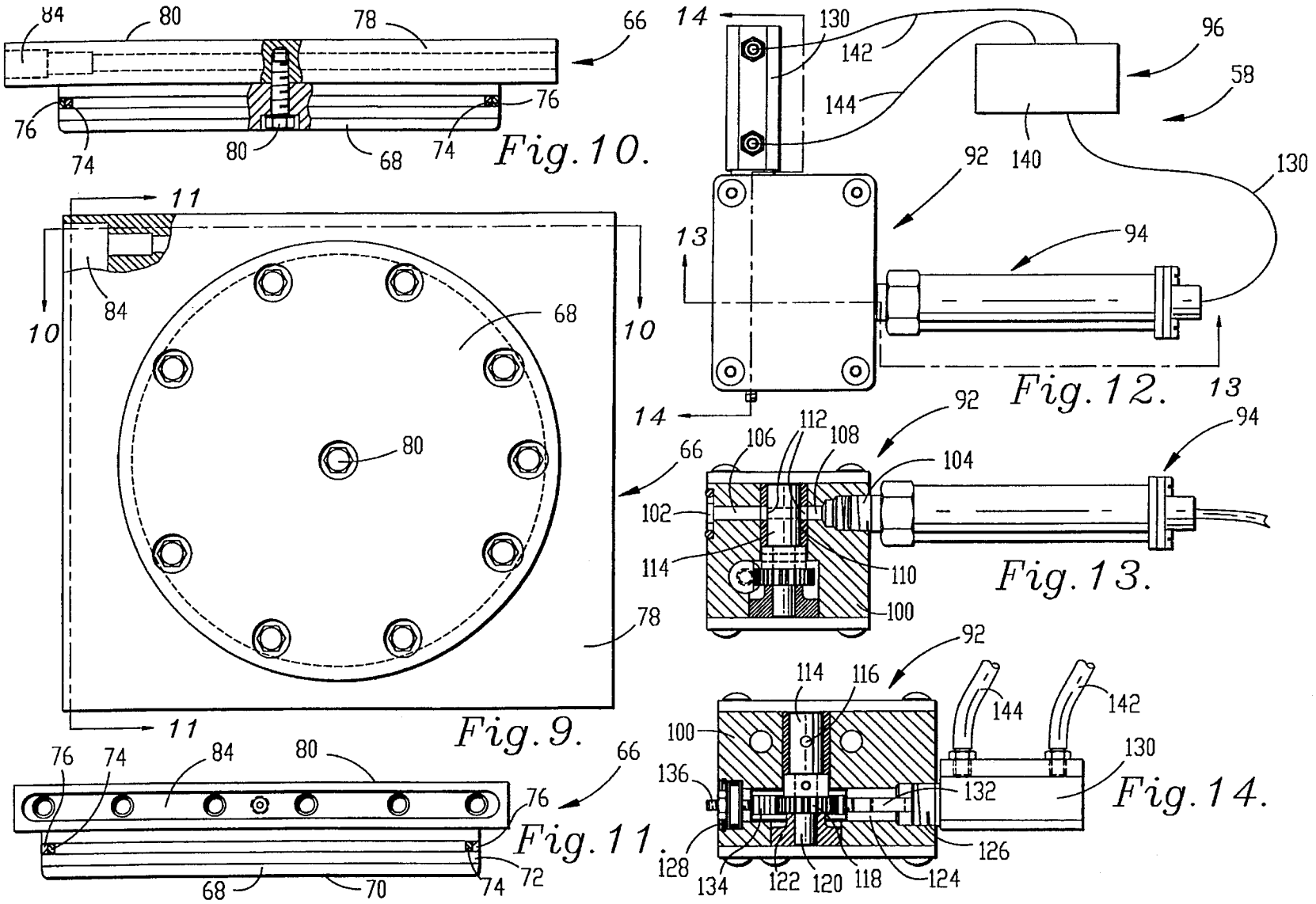
FIG. 9 is a bottom view of the piston and platen subassembly forming a part of the self-adjusting platen assembly.
FIG. 10 is a view taken along line 10—10 of FIG. 9, and with parts broken away, which further depicts the construction of the piston and platen subassemblies.
FIG. 11 is a view taken along line 11—11 of FIG. 9.
FIG. 12 is a partially schematic view illustrating the general construction of the fluid pressure sensor forming a part of the self-adjusting platen assembly.
FIG. 13 is a sectional view taken along line 13—13 of FIG. 12 and illustrating the safety valve assembly forming a part of the pressure sensor.
FIG. 14 is a sectional view taken alone line 14—14 of FIG. 12 and depicting the flow-blocking position of the safety valve.

A piston and platen subassembly 66 is positioned partially within reservoir 50. Turning to FIGS. 9–11, the subassembly 66 includes a lower piston 68 presenting a flat bottom face 70 and a vertical sidewall 72 provided with a peripheral recess 74. A seal 76 is positioned within recess 74 as shown and is adapted to sealingly engage reservoir sidewall 51.

The overall subassembly 66 further includes an upper platen 78 which is affixed to piston 68 by a series of bolts 80. It will be observed in this respect that the platen 78 has greater transverse dimensions than the depending piston 68. The platen 78 presents an uppermost operating surface 80 which is for supporting a workpiece as will be described. In addition, the platen 78 has a plurality of elongated passageways 82 communicating with a common header zone 84. The passageways 82 are designed to receive heating coils (not shown) which may be optionally provided for heating of platen 78.

Referring to FIGS. 5–6, it will be seen that a pair of stationary plates 86, 88 are secured by bolts to surface 48 of die shoe 46 one opposite sides of platen 78. The plates 86, 88 have a thickness substantially equal to that of platen 78. In addition, the plate 86 is provided with a channel 90 (see FIG. 8) to allow passage of electrical wires to the header zone 84 in order to provide electrical power to the heating elements within passageways 82.

The construction of pressure sensor 58 can best be understood from the depiction in FIGS. 12–14. Sensor 58 includes a safety valve 92, a pressure transducer 94 and a controller 96. As shown, the safety valve 92 is coupled to the end of shoe 46 by means of mounting bolts 98.

The safety valve 92 includes a block 100 having an inlet 102, threaded outlet 104, and a pair of relatively short fluid flow openings 106, 108 respectively in communication with inlet 102 and outlet 104. The block 100 also includes an upright tubular bushing 110 having opposed circular openings 112 in the sidewall thereof respectively in registry with openings 106 and 108. An upright, axially pivotal valve member 114 is situated within bushing 110 and has a passageway 116 therethrough oriented at a level for registry with bushing openings 112. A pinion gear 118 is affixed to the lower end of valve member 114. A lower pinion mounting shaft 120, pivotal within an upright bushing 122, is located below pinion gear 118.

The block 100 is also provided with a transverse bore 124 below valve member 16. The bore 124 has enlarged, threaded ends 126, 128. A solenoid valve operator 130 is threadably coupled within bore end 126. The operator 130 has an elongated operating rod 132 which extends into bore 124 as shown. A rack gear 134 is affixed to rod 132 and is in meshed engagement with pinion gear 118. The opposite threaded end 128 of bore 124 is provided with an end plug 136.

Transducer 94 is threadably coupled into outlet end 104 of block 100. The transducer is thus in communication with opening 108 described previously. An electrical output wire 138 extends from transducer 94 to controller 140. The latter is coupled via electrical wires 142, 144 to operator 130.

As best seen in FIG. 5, safety valve 92 is attached to die shoe 46 so that inlet 102 of block 100 is in communication with passageway 54. In this fashion, motive fluid within reservoir 50 travels through passage way 54 to pressure sensor 58 and ultimately to transducer 94.

Figure 4:
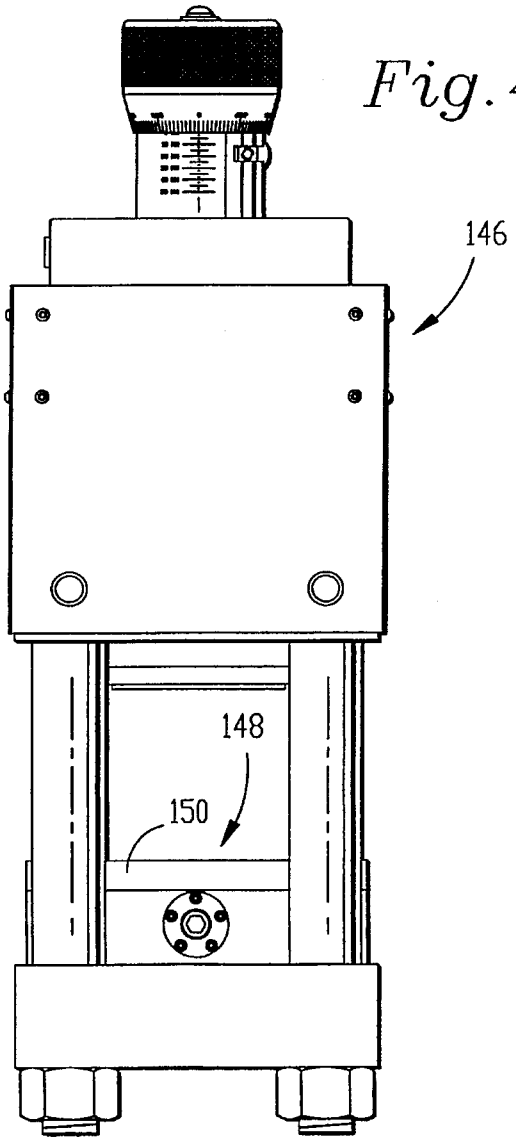
FIG. 4 is an end view of the press depicted in FIG. 3.
Figure 3:
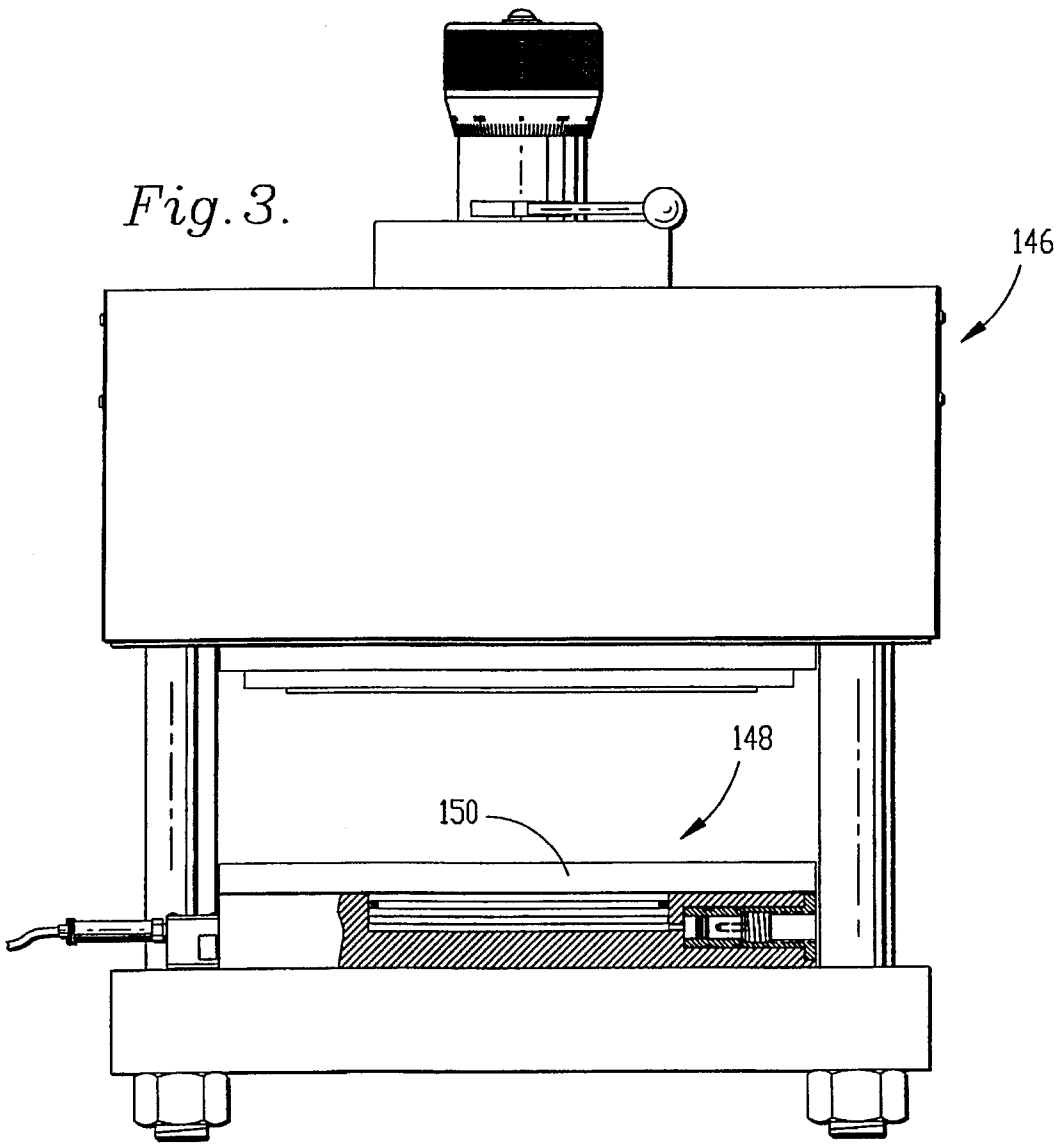
FIG. 3 is a side view similar to that of FIG. 1 and illustrating another embodiment making use of a unitary platen member.

FIGS. 3–4 illustrate a second embodiment of the invention in the form of a stamping press 146. The press 146 is in most respects identical with the embodiment of FIGS. 1–2. However, in this case, the piston and platen subassembly 148 includes an upper, unitary platen 150 which extends over essentially the entire possible operating surface of the press. It thus differs from the FIGS. 1–2 embodiment, where the latter includes a smaller platen 78 with stationary plates 86, 88 located on opposite sides of platen 78.

The use of illustrative die set 28 carried by press 20 is best depicted in FIG. 15, which is shown in an exaggerated format for purposes of illustration. The platen assemblies 30, 32 are moved together to operate on workpiece W and thereby create desired cuts, crease lines, perforations on other alterations in the workpiece. FIG. 15 depicts a situation where the piston and platen subassembly 66 has been rocked about an axis parallel with platen operating face 80 during such use in order to accommodate the position and orientation of rule 44. It will be appreciated that the piston 68 (and hence platen 78) is self-adjusting and will shift and rock within reservoir 50 as required to bring the platen 78 into parallelism with the die set 28. Generally, the shifted position of the subassembly will be determined by the three lowest points presented by rule 44, or other operating die making up die set 28.

The vertical rest position of platen 78 can be altered through the medium of piston 62. That is, piston 62 may be adjusted inwardly or outwardly within threaded insert 60 through the use of a conventional Allen wrench. Movement of the piston leftwardly as viewed in FIG. 7 has the effect of raising the subassembly 66, whereas the opposite effect is achieved by rightward movement of the piston 62.

During use of press 20, it is often desirable to monitor the fluid pressure within reservoir 50. To this end, the sensor 58 is provided. In normal use as shown in FIG. 13, fluid from reservoir 50 flows through passageway 54 through inlet 102, passageways 106 and 112, bore 116 and passageways 112, 108 so that the fluid pressure may be sensed by transducer 94. In the event that pressure above a predetermined maximum is experienced within reservoir 50, the safety valve 92 comes into play in order to prevent damage to the transducer 94. That is, transducers of this type are designed to monitor and sense pressures of only a certain magnitude range, and can be destroyed if they experience significant overpressures for extended periods. In any case, the safety valve 92 operates to rotate valve member 114 to the FIG. 14 position thereof when an overpressure is sensed. This is accomplished through controller 140 which actuates solenoid operator 130. When this occurs, rod 132 is shifted leftwardly as viewed in FIG. 14, thereby rotating pinion gear 118. This has the effect of pivoting valve member 114 90° so that passageway 116 therethrough is moved out of communication with the overall fluid flow path between reservoir 50 and transducer 94. The controller 140 (which is normally a computer) wired to other sensors associated with press 20 and, after suitable inputs are received, will again actuate operator 130 to retract rod 132 rightwardly as viewed in FIG. 14, thereby pivoting valve member 114 back to the normal use position thereof depicted in FIG. 13.

The provision of sensor 58 and associated controller 96 allows two preset pressures to be established for serial operations of the stamping press. For example, one predetermined pressure can be established through use of the sensor 58 for a first operation on a workpiece, and a second different predetermined pressure established for a second operation, either on the same workpiece, or a successive workpiece. The controller 96 and sensor 58 in cooperation permit the user for example to punch in a first pressure value on a keypad of controller 96 (which may be a stand-alone computer), and then key in a separate second pressure value. The controller then serves to limit the force applied by die set 28 to the predetermined values established by the user that are keyed into the system. It is to be understood in this respect that although the actual pressure sensed by transducer 58 in pounds per square inch is not the same force applied to the workpiece by die set 28 during downward movement thereof, a correlation can readily be determined between the pressure readout of transducer 58 and the actual force of the die set applied against the workpiece. This mathematical correlation can be programmed into the computer controller 96 so that when a value is keyed into the controller, that value is directly related to the force applied by the die set 28 during operation of the stamping press.

A piston and platen assembly 66 may be mounted within upper platen assembly 30 as a part of the hydraulic ram forming a part of press head 24. Alternatively, a series of smaller piston and platen subassemblies 66 may be provided, either as a part of lower bolster 22, or incorporated into the upper platen assembly 30, in order to cover larger platen areas, as for example in presses having a platen area in order of 20×24 inches.

Furthermore, a completely static unit may be provided wherein the sensor 58 and an associated controller is omitted, or the sensor and its controller senses only high pressure to prevent damage to the sensor, without the provision of a low pressure sensing option.

I claim:

1. In a die set including first and second, opposed, relatively shiftable cooperating die platen assemblies, at least one of which has a die for operating on a workpiece placed between the platen assemblies, the improvement which comprises a self-leveling assembly for one of the platen assemblies, said self-leveling assembly comprising:

a shoe having a cavity region presenting a fluid reservoir;

a piston having an outer main surface and an inner surface parallel to the outer surface, said piston being rockably positioned within said reservoir in disposition resting on and in direct contact with the fluid therein; and an adjustable platen presenting an operating face and an opposed mounting face, said adjustable platen being carried by said piston with the main surface of the piston engaging at least the central area of the mounting face of the adjustable platen, said piston and adjustable platen being freely rockable as a unit about two perpendicular axes both parallel with said platen operating face to automatically adjust the orientation of said adjustable platen operating face with respect to the opposed platen assembly to maintain parallelism between the work engaging parts of the platen assemblies at the time each time said at least one die is brought into an operating position against the workpiece.

2. The die set of claim 1, including means for selectively adjusting a rest location of the piston and said adjustable platen.

3. The die set of claim 2, said rest location adjusting means comprising an elongated, tubular body, means communicating said reservoir and the interior of said tubular body, and a piston member shiftably located within said body for blocking fluid flow past the piston member.

4. The die set of claim 1, including structure for detecting the fluid pressure within said reservoir during use of said die set.

5. The die set of claim 4, said pressure detecting structure including a pressure transducer, means defining a fluid passageway for establishing fluid communication between said transducer and said reservoir for detecting said fluid pressure therein, and means for selectively blocking said fluid passageway in the event that said fluid pressure exceeds a predetermined maximum.

6. The die set of claim 5, said means for selectively blocking said fluid communication comprising a shiftable element having a bore therethrough, and means operably coupled with said element for moving the element between a first position wherein said bore forms a part of said fluid passageway to communicate said reservoir and said transducer, and a second position wherein said bore is moved out of said fluid passageway to block said fluid communication.

7. The die set of claim 1, including means for heating said platen.

8. The die set of claim 7, said heating means comprising a plurality of electrical heating coils embedded within said platen.

9. A self-leveling die platen assembly for use with a cooperating die platen assembly to form a die set, said self-leveling die platen assembly comprising:

a shoe having a cavity region presenting a fluid reservoir;

a piston having an outer main surface and an inner surface parallel to the outer surface, said piston being rockably positioned within said reservoir in disposition resting on and in direct contact with the fluid therein; and an adjustable platen presenting an operating face and an opposed mounting face, said adjustable platen being carried by said piston with the main surface of the piston engaging at least the central area of the mounting face of the adjustable platen, said piston and adjustable platen being freely rockable as a unit about two perpendicular axes both parallel with said platen operating face to automatically adjust the orientation of said adjustable platen operating face with respect to the opposed platen assembly to maintain parallelism between the work engaging parts of the platen assemblies at the time each time said at least one die is brought into an operating position against the workpiece.

10. The die platen assembly of claim 9, including means for selectively adjusting a rest location of the piston and said adjustable platen.

11. The die platen assembly of claim 10, said rest location adjusting means comprising an elongated, tubular body, means communicating said reservoir and the interior of said tubular body, and a piston member shiftably located within said body for blocking fluid flow past the piston member.

12. The die platen assembly of claim 9, including structure for detecting the fluid pressure within said reservoir during use of said die set.

13. The die platen assembly of claim 12, said pressure detecting structure including a pressure transducer, means defining a fluid passageway for establishing fluid communication between said transducer and said reservoir for detecting said fluid pressure therein, and means for selectively blocking said fluid passageway in the event that said fluid pressure exceeds a predetermined maximum.

14. The die platen assembly of claim 13, said means for selectively blocking said fluid communication comprising a shiftable element having a bore therethrough, and means operably coupled with said element for moving the element between a first position wherein said bore forms a part of said fluid passageway to communicate said reservoir and said transducer, and a second position wherein said bore is moved out of said fluid passageway to block said fluid communication.

15. The die platen assembly of claim 9, including means for heating said platen.

16. The die platen assembly of claim 15, said heating means comprising a plurality of electrical heating coils embedded within said platen.

* * * * *